US009670695B2

(12) United States Patent
Zuraski et al.

(10) Patent No.: US 9,670,695 B2
(45) **Date of Patent: *Jun. 6, 2017**

(54) RESETTABLE COMBINATION LOCK MECHANISM

(71) Applicant: Schlage Lock Company LLC, Indianapolis, IN (US)

(72) Inventors: Robert D. Zuraski, Taunton, MA (US); Son M. Luong, Haverhill, MA (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/051,163

(22) Filed: Feb. 23, 2016

(65) Prior Publication Data

US 2016/0273242 A1 Sep. 22, 2016

Related U.S. Application Data

(63) Continuation of application No. 13/964,011, filed on Aug. 9, 2013, now Pat. No. 9,267,312.

(Continued)

(51) Int. Cl.

| | |
|---|---|
| ***E05B 37/02*** | (2006.01) |
| ***E05B 37/00*** | (2006.01) |
| ***E05B 37/04*** | (2006.01) |

(52) U.S. Cl.

CPC ..... *E05B 37/0058* (2013.01); *E05B 37/0048* (2013.01); *E05B 37/025* (2013.01);

(Continued)

(58) Field of Classification Search

CPC ..... E05B 37/0048; E05B 37/0058; E05B 37/025; E05B 37/02; E05B 37/04;

(Continued)

(56) References Cited

U.S. PATENT DOCUMENTS 4,341,101 A * 7/1982 Bako ..... E05B 37/02 70/312
4,343,164 A * 8/1982 Bako ..... E05B 37/02 70/312

(Continued)

FOREIGN PATENT DOCUMENTS

CN 2844341 Y 12/2006

OTHER PUBLICATIONS

Canadian Office Action; Canadian Intellectual Property Office; Canadian Application No. 2,882,278; Mar. 4, 2016; 2014; 3 pages.

(Continued)

*Primary Examiner* — Lloyd Gall
(74) *Attorney, Agent, or Firm* — Taft Stettinius & Hollister LLP

(57) ABSTRACT

A resettable combination lock mechanism includes a plurality of outer lock dials and a plurality of inner lock dials. The rotation of a reset feature changes the relative axial position between the outer lock dials and the inner lock dials, allowing the combination of the lock mechanism to be reset. In one aspect, the outer lock dials are axially displaced upon rotation of the reset feature, exposing a visual indicator that is configured to indicate whether the lock is in a combination reset mode or is in a normal mode. The reset mode allows the combination to be changed. The normal mode allows the lock mechanism to be locked or unlocked to secure or release a desired item. In another aspect, the rotation of the reset feature rotates a visual indicator into alignment with a window to indicate that the lock is the reset mode or the normal mode.

18 Claims, 7 Drawing Sheets

Related U.S. Application Data

(60) Provisional application No. 61/681,536, filed on Aug. 9, 2012.

(52) U.S. Cl.
CPC ..... *E05B 37/04* (2013.01); *Y10T 70/7305* (2015.04); *Y10T 70/7322* (2015.04); *Y10T 70/8027* (2015.04)

(58) Field of Classification Search
CPC ..... E05B 37/08; E05B 37/10; E05B 41/00; Y10T 70/7322; Y10T 70/7305; Y10T 70/8027
USPC ..... 70/312, 432
See application file for complete search history.

(56) References Cited

U.S. PATENT DOCUMENTS 4,354,366 A * 10/1982 Bako ..... E05B 37/02 70/312
4,355,524 A * 10/1982 Bako ..... E05B 37/02 70/312
4,389,863 A * 6/1983 Bako ..... E05B 37/02 70/312
4,520,641 A * 6/1985 Bako ..... E05B 37/02 70/312
5,027,623 A * 7/1991 Ling ..... E05B 37/02 70/26
5,636,539 A * 6/1997 Tsai ..... E05B 37/02 70/30
5,899,099 A * 5/1999 Tsai ..... E05B 37/10 70/26
5,934,120 A * 8/1999 Kuo ..... E05B 37/02 70/30
6,209,368 B1 * 4/2001 Lee ..... E05B 37/025 70/30
6,386,005 B1 * 5/2002 Kuo ..... E05B 37/025 70/28
6,422,051 B1 * 7/2002 Kuo ..... E05B 37/02 70/312
6,439,006 B1 * 8/2002 Tsai ..... E05B 37/025 70/233
6,508,089 B1 * 1/2003 Tsai ..... E05B 37/0034 70/213
6,598,434 B2 * 7/2003 Yang ..... E05B 37/02 70/213
6,711,922 B1 * 3/2004 Tsai ..... E05B 37/025 70/30
6,799,445 B1 * 10/2004 Tsai ..... E05B 37/0031 70/284
6,799,446 B1 * 10/2004 Tsai ..... E05B 37/02 70/26
6,845,643 B2 * 1/2005 Tsai ..... E05B 37/0031 70/26
7,131,299 B1 * 11/2006 Huang ..... E05B 37/0034 70/21
7,216,517 B2 * 5/2007 Ling ..... E05B 37/0034 70/21
D545,174 S * 6/2007 Sloan ..... D8/334
7,254,971 B2 * 8/2007 Ruan ..... E05B 37/025 70/21
7,337,637 B2 * 3/2008 Kan ..... E05B 37/025 70/30
7,357,007 B2 * 4/2008 Lin ..... E05B 35/105 70/21
7,370,497 B2 * 5/2008 Yu ..... E05B 35/105 70/21
7,415,853 B2 * 8/2008 Yu ..... E05B 37/02 70/21
7,467,529 B1 * 12/2008 Lai ..... E05B 35/105 70/18
7,510,301 B2 * 3/2009 Dial ..... A45C 13/20 362/100
7,568,367 B2 * 8/2009 Huang ..... A44B 11/266 70/284
7,832,238 B2 * 11/2010 Misner ..... E05B 35/105 70/21
7,870,764 B2 * 1/2011 Burmesch ..... E05B 37/025 70/233
7,946,141 B2 * 5/2011 Ng ..... E05B 37/02 70/21
8,234,891 B2 * 8/2012 Dalton, Jr. ..... E05B 13/103 70/21
8,353,184 B2 * 1/2013 Ling ..... E05B 35/105 70/21
8,393,186 B2 * 3/2013 Schmidt ..... E05B 37/025 70/22
8,453,481 B2 * 6/2013 Meekma ..... E05B 47/0012 70/25
9,175,502 B2 * 11/2015 Zuraski ..... E05B 37/0048
9,267,312 B2 * 2/2016 Zuraski ..... E05B 37/0048
2006/0107708 A1 * 5/2006 Yu ..... E05B 37/025 70/21
2008/0006067 A1 1/2008 Kan
2011/0041574 A1 * 2/2011 Yang ..... E05B 37/02 70/315
2011/0239715 A1 * 10/2011 Weiershausen ..... E05B 37/025 70/315
2013/0118219 A1 * 5/2013 Basche ..... E05B 37/025 70/315

OTHER PUBLICATIONS

Chinese Search Report; State Intellectual Property Office of China; Chinese Application No. 201380052532.3; Jul. 18, 2016; 2014; 2 pages.
Chinese Office Action; State Intellectual Property Office of China; Chinese Application No. 201380052532.3; Jul. 29, 2016; 2014; 4 pages.
Supplementary European Search Report; European Patent Office; European Application No. EP13 82 8413; Dec. 21, 2016; 5 pages.
International Search Report; International Searching Authority, US Patent and Trademark Office; International Application No. PCT/US2013/054432; Jan. 16, 2014; 2 pages.
Written Opinion; International Searching Authority, US Patent and Trademark Office; International Application No. PCT/US2013/054432; Jan. 16, 2014; 4 pages.

* cited by examiner

RESETTABLE COMBINATION LOCK MECHANISM

CROSS REFERENCE TO RELATED APPLICATIONS

The present application is a continuation of U.S. patent application Ser. No. 13/964,011 filed Aug. 9, 2013, now U.S. Pat. No. 9,267,312, which claims benefit of U.S. Provisional Patent Application No. 61/681,536 filed Aug. 9, 2012. The disclosure of each of the prior applications is incorporated herein by reference in its entirety.

FIELD OF THE INVENTION

The present invention relates to lock devices, and more particularly to a combination lock mechanism configured to allow the changing of its combination and to provide feedback to a user indicative of whether the lock mechanism is in the combination resetting mode.

BACKGROUND

Lock mechanisms, such as combination lock mechanisms, remain an area of interest. Some existing systems have various shortcomings, drawbacks, and disadvantages relative to certain applications. For example, although some lock mechanisms may allow the combination to be reset, it may be difficult for the user to determine whether or not the lock mechanism is presently able to function as a lock or is in a reset mode for changing the combination. Accordingly, there remains a need for further contributions in this area of technology.

SUMMARY

A resettable combination lock mechanism includes a plurality of outer lock dials and a plurality of inner lock dials. The rotation of a reset feature changes the relative axial position between the outer lock dials and the inner lock dials, allowing the combination of the lock mechanism to be reset. In one aspect, the outer lock dials are axially displaced upon rotation of the reset feature, exposing a visual indicator that is configured to indicate whether the lock is in a combination reset mode or is in a normal mode. The reset mode allows the combination to be changed. The normal mode allows the lock mechanism to be locked or unlocked to secure or release a desired item. In another aspect, the rotation of the reset feature rotates a visual indicator into alignment with a window to indicate that the lock is the reset mode or the normal mode.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
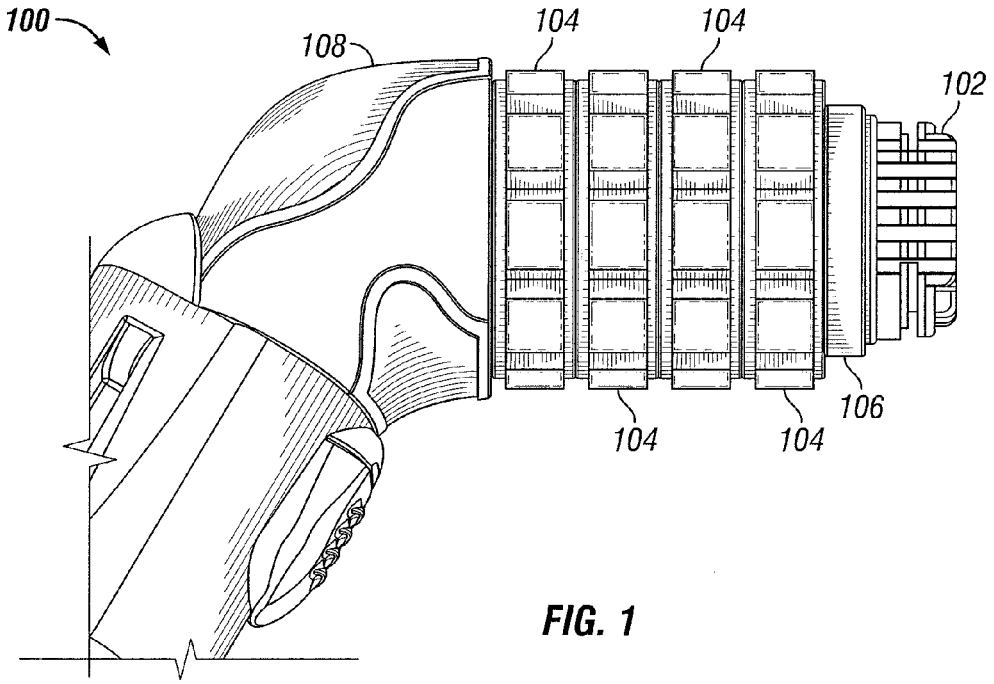
FIG. 1 is a side view of a resettable combination lock mechanism in accordance with the non-limiting example of an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Figure 2:
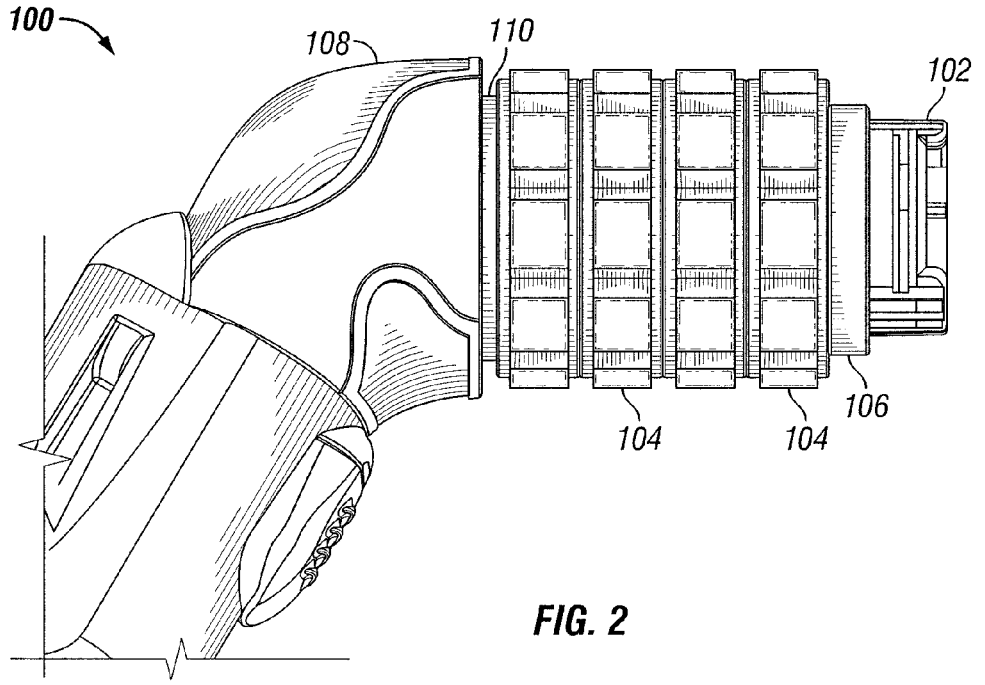
FIG. 2 is a side view of a resettable combination lock mechanism in accordance with a non-limiting example of an embodiment of the present invention, illustrating an exposed visual indicator that is configured to indicate that the resettable combination lock mechanism is in the reset mode.

Referring to FIGS. 1 and 2, some aspects of a non-limiting example of a lock assembly 100 in the form of a resettable combination lock mechanism in accordance with an embodiment of the present invention are depicted. In one form, resettable combination lock mechanism 100 is a cable lock e.g., such as may be used to secure a motorcycle or bicycle against theft. In other embodiments, resettable combination lock mechanism 100 may take one or more other forms, and may be any type of combination lock configured to allow the combination to be reset, e.g. at the discretion of the user, owner and/or operator (e.g., of the resettable combination for mechanism 100 and/or of the device sought to be secured by resettable combination lock mechanism 100).

Resettable combination lock mechanism 100 includes a reset knob 102, a plurality of outer lock dials 104, a knob spacer 106 and a support structure 108. Reset knob 102 is operative to switch resettable combination lock mechanism 100 from a normal mode to a reset mode. The normal mode is that mode in which resettable combination lock mechanism 100 is capable of functioning as a lock, e.g., to lock or unlock to secure or release an object, such as a bicycle, motorcycle, other motor vehicle, a door, a locker or another type of object, e.g., against theft. The reset mode is that mode in which resettable combination lock mechanism 100 permits the combination of lock mechanism 100 to be changed, e.g., as desired by a user, owner and/or operator. In one form, reset knob 102 is hand-operated. In a particular form, reset knob 102 is operated by grasping reset knob 102 by hand, and turning it from a first rotational position to a second rotational position or vice versa, e.g. in a clockwise or counterclockwise direction. In the first rotational position, resettable combination lock mechanism 100 is in the normal mode. When reset knob 102 is turned to the second rotational position, resettable combination lock mechanism 100 is in the reset mode. In other embodiments, reset knob 102 may be operated by other means, e.g., an electric motor or a spring. Although rotatable, reset knob 102 is retained in a fixed axial position. As used herein, the axial direction extends in the direction of the centerline about which reset knob 102 and outer lock dials 104 rotate. In various embodiments, reset knob 102 may be configured to be displaced rotationally and/or translationally in order to switch between normal and reset modes.

Outer lock dials 10 are operative to be rotated by the user in order to unlock resettable combination lock mechanism 100 when in the normal mode, and to reset the combination of resettable combination lock mechanism 100 when in the reset mode. Knob spacer 106 is disposed between outer lock dials 104 and reset knob 102. Knob spacer 106 is anti-rotated, and in some embodiments may be configured for axial displacement, e.g., toward and away from reset knob 102, such as in the embodiment illustrated in FIGS. 1-9. Support structure 108 supports the locking portion of resettable combination lock mechanism 100. Extending from support structure 108 is female locking post, described below. In one form, support structure 108 is a lock body. In other embodiments, support structure 108 may take other forms, for example, a structure coupled to, fixed to or integral with another device, e.g., a bicycle, motorcycle, other motor vehicle, door or any other device for which it is desired to have a locking capability.

The ability to reset the combination of a combination lock mechanism is desirable for various reasons e.g., to improve security, or to prevent access by persons previously authorized to operate the combination lock mechanism. However, if the combination lock mechanism does not provide the user with sufficient feedback to indicate whether the combination lock mechanism is in the normal mode or the reset mode, undesirable results may ensue. For example, the user may become frustrated with the combination lock mechanism due to the difficulty of operating it, or security may be reduced e.g. by accidentally retaining the combination lock mechanism in the reset mode or by rendering it unpleasant to reset the combination lock mechanism to a degree such that the user may choose not to use the reset feature, thereby forfeiting the potential security advantages of having a resettable combination lock mechanism. Accordingly, embodiments of the present invention include a visual indicator that provides the user, owner and/or operator of the inventive resettable combination lock mechanism described herein with a visual cue indicating when the resettable combination lock mechanism is in the reset mode. In other embodiments, the visual indicator may alternately provide a visual cue that the resettable combination lock mechanism is in the normal mode. In still other embodiments, the visual indicator may have one or more components that provide a visual cue where the resettable combination lock mechanism is in the normal mode, and a visual cue when the resettable combination lock mechanism is in the normal mode. In one form the absence of the visual cue indicates that the resettable combination lock mechanism is in normal mode. In other embodiments, another visual cue may indicate to the user or owner that the resettable combination lock mechanism is in the normal mode.

Figure 3:
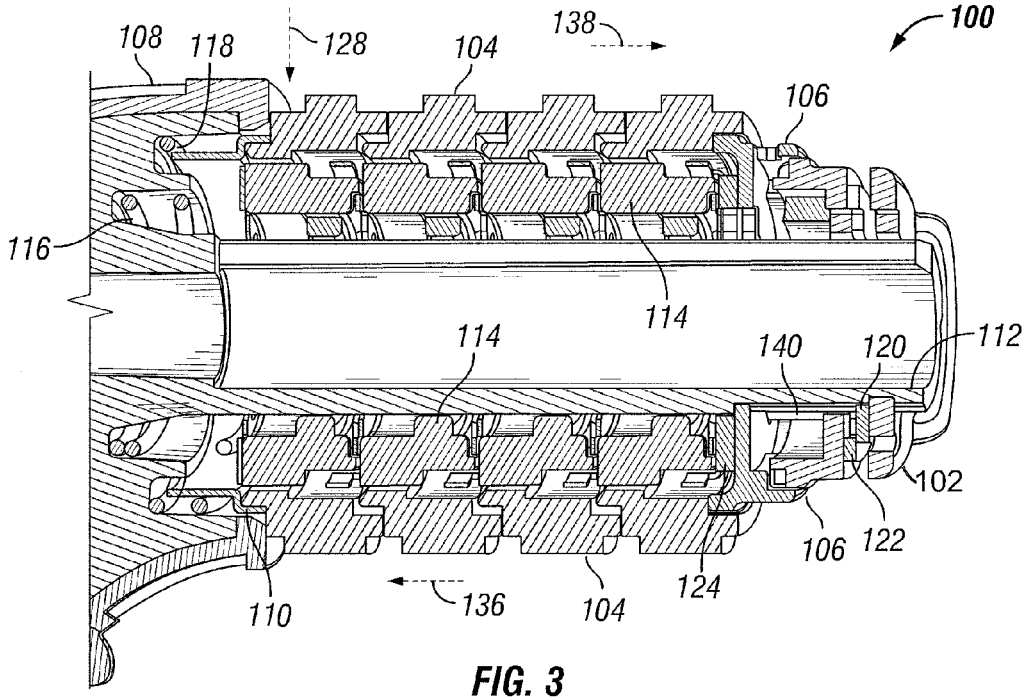
FIG. 3 is a sectional view of a resettable combination lock mechanism in accordance with a non-limiting example of an embodiment of the present invention, wherein the components of the lock mechanism are oriented in same position as that illustrated in FIG. 1.
Figure 4:
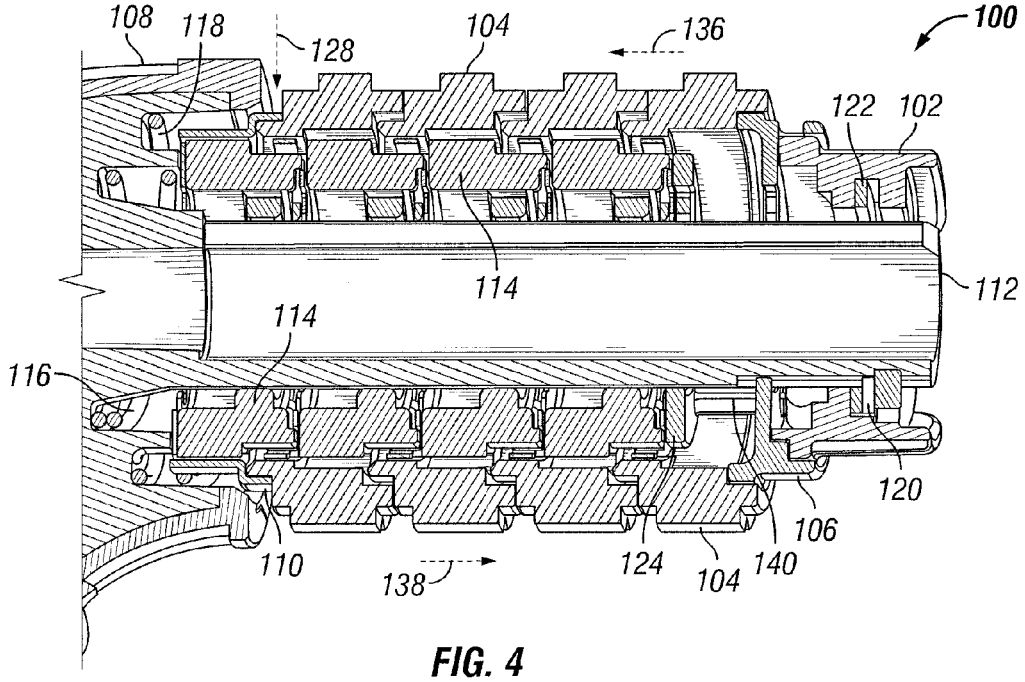
FIG. 4 is a sectional view of a resettable combination lock mechanism in accordance with a non-limiting example of an embodiment of the present invention, wherein the components of the lock mechanism are oriented in same position as that illustrated in FIG. 2.

In the embodiment depicted in and described with respect to FIGS. 1-9, resettable combination lock mechanism 100 includes a visual indicator 110 that is configured to indicate when resettable combination lock mechanism 100 is in the reset mode. Visual indicator 110 is exposed to the view of an observer of resettable combination lock mechanism 100 upon the rotation of reset knob 102 into the second rotational position, which, in the embodiment of FIGS. 1-9, results in the axial displacement of knob spacer 106 toward reset knob 102 (from left to right in the depiction of FIGS. 1-4). In one form, visual indicator 110 is a spring spacer, although it will be understood that in various embodiments, visual indicator 110 may take any suitable form. Outer lock dials 104 are biased toward knob spacer 106 and into axial engagement with knob spacer 106 by a spring 118 (FIGS. 3 and 4). The axial displacement of knob spacer 106 thus results in the axial displacement of outer lock dials 104 toward reset knob 102, thereby uncovering visual indicator 110. In one form, visual indicator 110 is colored, e.g., brightly colored, such as the color red. In other embodiments, visual indicator 110 may have some eye-catching pattern on its surface in addition to or in place of being colored. In still other embodiments, visual indicator 110 may also or alternatively be illuminated, e.g. via backlighting, direct lighting, photoluminescence, phosphorescence or other means of illumination.

Figure 5:
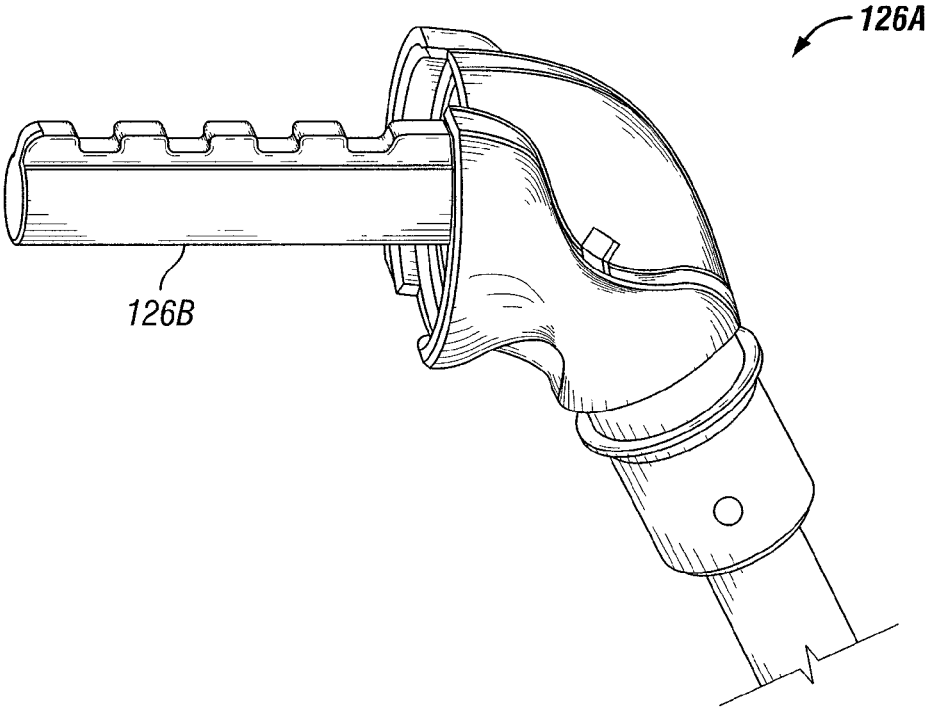
FIG. 5 illustrates some aspects of a non-limiting example of a male portion of the lock mechanism configured to be received into the female portion illustrated in FIGS. 3 and 4.

Referring to FIGS. 3-5, some aspects of a non-limiting example of resettable combination locking mechanism 100 in accordance with an embodiment of the present invention are illustrated in cross-section. Resettable combination locking mechanism 100 further includes a shaft 112, a plurality of inner lock dials 114, a biasing spring 116, a biasing spring 118, a retaining ring 120, a washer 122, a reset slide member 124, and a male lock component 126A having a male locking post 126B. Shaft 112 extends from support structure 108. In one form, shaft 112 is integral with support structure 108. In other embodiments, shaft 112 may be coupled or affixed to support structure 108. In still other embodiments, shaft 112 may not have any direct mechanical connection to support structure 108, and may be integral with, or coupled or affixed to another component. In one form, shaft 112 is a female locking post configured to receive therein male locking post 126B. Shaft 112 may also be referred to as an inner lock post. In other embodiments, shaft 112 may take other forms. Inner lock dials 114 are disposed on shaft 112. Outer lock dials 104 are disposed radially outward of inner lock dials 114. Outer lock dials 104 and inner lock dials 114 are configured to rotationally engage and lock to each other when in a first relative axial position (i.e., a relative axial position being an axial position of outer lock dials 104 and inner lock dials 114 relative to each other), e.g., as depicted in FIG. 3. Outer lock dials 104 and inner lock dials 114 are configured to disengage and unlock from each other and permit relative rotation therebetween when in a second relative axial position e.g., as depicted in FIG. 4. In one form, outer lock dials 104 and inner lock dials 114 are engaged with each other and rotationally locked to each other when they are in relative axial alignment, as illustrated in FIG. 3; and are disengaged from each other when they are in relative axial misalignment, as illustrated in FIG. 4. In one form, outer lock dials 104 and inner lock dials 114 each have lugs that engage each other and rotationally lock outer lock dials 104 and inner lock dials 114 together when in the first relative axial position, and disengage in the second relative axial position. Visual indicator 110 is disposed about shaft 112. Resettable combination lock mechanism 100 is configured via outer lock dials 104 and visual indicator 110 to expose at least a part of visual indicator 110 to the view of an observer viewing resettable combination lock mechanism, e.g., from a direction 128, when outer lock dials 104 and inner lock dials 114 are in the second relative axial position, and to hide the visual indicator from the view of the observer when the outer lock dials and inner lock dials are in the first relative position. In other embodiments, resettable combination lock mechanism 100 may be configured via outer lock dials 104 and visual indicator 110 to expose at least a part of visual indicator 110 to the view of the observer when outer lock dials 104 and inner lock dials 114 are in the first relative axial position, and to hide the visual indicator from the view of the observer when the outer lock dials and inner lock dials are in the second relative position.

The disengagement of outer lock dials 104 and inner lock dials 114 from each other is obtained by turning reset knob 102 from the first rotational position to the second rotational position. This disengagement provides for resetting the combination of resettable combination lock mechanism 100 by rotating outer lock dials 104 relative to inner lock dials 114 to achieve the desired combination, at which point reset knob 102 is turned from the second rotational position back to the first rotational position to lock in the new combination and return resettable combination lock mechanism 100 to the normal mode.

Figure 6:
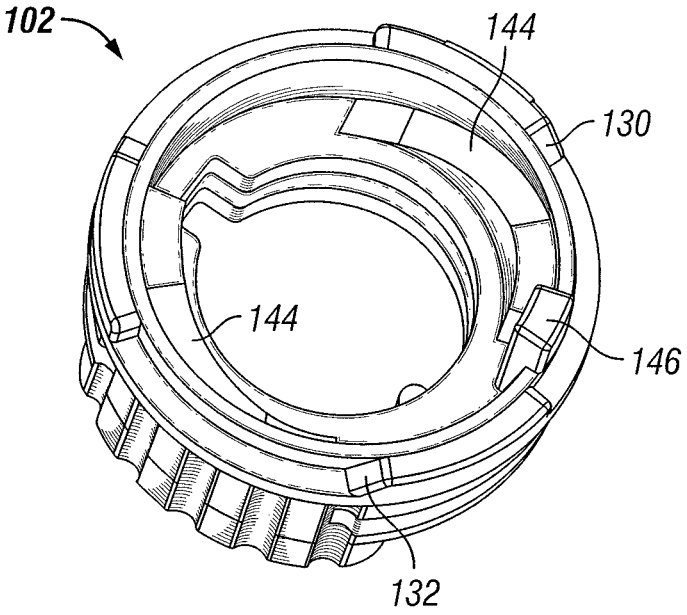
FIG. 6 illustrates some aspects of a non-limiting example of a hand-operated reset-normal mode selector in accordance with an embodiment of the present invention.
Figure 7:
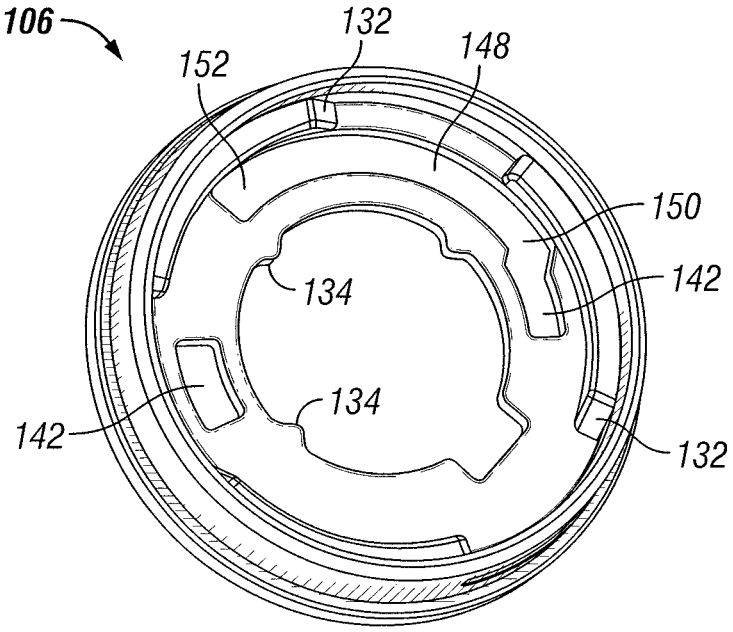
FIG. 7 illustrates some aspects of a non-limiting example of a component configured to engage with the hand-operated reset-normal mode selector of FIG. 6 in accordance with an embodiment of the present invention.

Referring additionally to FIGS. 6 and 7, reset knob 102 is disposed about shaft 112, and is configured to be axially restrained (axially fixed) on shaft 112 and to rotate about shaft 112. In one form, reset knob 102 is axially restrained on shaft 112 via retaining ring 120 and washer 122. In other embodiments, reset knob 102 may be axially restrained via other means. Knob spacer 106 is disposed about shaft 112. Knob spacer 106 is configured to be rotationally restrained (rotationally fixed) about shaft 112, i.e., is not free to rotate, and is configured for axial displacement along shaft 112. Biasing spring 116 is configured to bias the inner lock dials toward reset knob 102. In the illustrated embodiment, biasing spring 116 biases inner lock dials 114 against reset knob 102 via reset slide member 124. Biasing spring 118 is configured to bias outer lock dials 104 against knob spacer 106. Reset knob 102 and knob spacer 106 include axial displacement features that are configured to drive knob spacer 106 and outer lock dials 104 against the bias of biasing spring 118 toward engagement of outer lock dials 104 with inner lock dials 114 when reset knob 102 is rotated toward the normal mode rotational position. The axial displacement features of reset knob 102 and knob spacer 106 are configured to permit knob spacer 106 and outer lock dials 104 toward disengagement of outer lock dials 104 with inner lock dials 114 under the impetus of biasing spring 118 when reset knob 102 is rotated toward the reset mode rotational position. In one form, the axial displacement features include one or more ramp structures 130 on reset knob 102 that are configured to engage corresponding ramp structures 132 on knob spacer 106. Ramp structures 130 and 132 each include a ramp portion and the dwell portion. The circumferential length and spacing of ramp structures 130 and 132 are configured to permit ramp structures 130 and 132 to oppose each other axially and force axial displacement between reset knob 102 and knob spacer 106 when reset knob 102 is rotated into the normal mode rotational position. The circumferential length and spacing of ramp structures 130 and 132 are configured to permit ramp structures 130 and 132 to nest between each other, allowing axial displacement between reset knob 102 and knob spacer 106 under the impetus of biasing spring 118 when reset knob 102 is rotated into the normal mode rotational position. In some embodiments, only one or the other of reset knob 102 and knob spacer 106 may include ramp structures. Rotation of reset knob 102 results in relative rotational displacement between reset knob 102 and knob spacer 106, because knob spacer 106 is rotationally restrained e.g., via anti-rotation tangs 134 that engage corresponding slots or other openings in shaft 112 to prevent rotation of knob spacer 106. Thus, as reset knob 102 is turned in one direction, i.e., toward the normal mode rotational position, ramp structures 132 and 130 engage each other, thereby driving reset knob 102 and knob spacer 106 axially apart from each other. Because reset knob 102 is axially restrained on shaft 112, the relative axial displacement between reset knob 102 and knob spacer 106 yields a displacement of knob spacer 106 in a direction 136, driving outer lock dials 104 toward engagement with inner lock dials 114. Conversely, as reset knob 102 is turned in the opposite direction i.e., toward the reset mode rotational position, ramp structures 130 and 132 become rotationally misaligned with each other and disengage from each other, and nest between each other, thereby allowing the axial displacement of outer lock dials 104 and knob spacer 106 in a direction 138 that is opposite to direction 136, thereby exposing visual indicator 110. Accordingly, reset knob 102 may be selectively rotated to selectively drive outer lock dials 104 and knob spacer 106 in direction 136 or direction 138. Although the present embodiment exposes visual indicator 110 when outer lock dials 104 and knob spacer 106 are axially displaced in direction 138, in other embodiments, the visual indicator may be exposed when outer lock dials 104 and/or knob spacer 106 are axially displaced in direction 136. For example, outer lock dials 104 and inner lock dials 114 may be configured to disengage from each other when outer lock dials 104 are axially displaced in direction 138 relative to inner lock dials 114, exposing a previously hidden visual indicator, e.g., on a portion of knob spacer 106 and/or reset knob 102.

Reset slide member 124 is disposed about shaft 112, and abuts inner lock dials 114 on one end. As with knob spacer 106, reset slide member 124 is configured to translate along shaft 112, but is restrained against rotation about shaft 112. Due to the fact that each of the knob spacer 106 and the reset slide member 124 is configured to translate along the shaft 112, the knob spacer 106 and the reset slide member 124 may be referred to as sliding components. Reset slide member 124 includes a plurality of lugs 140 that extend axially along the shaft 112 through anti-rotation openings 142 in knob spacer 106 and engage reset knob 102. Lugs 140 engage openings 142 to anti-rotate reset slide member 124. Reset knob 102 includes a plurality of ramps 144 corresponding in number to the number of lugs 140. In the present embodiment, two lugs 140 and two ramps 144 are employed, although a number of lugs and ramps may be employed in other embodiments. Ramps 144 are configured to engage lugs 140 and thereby axially displace reset slide member 124, and hence inner lock dials 114, in direction 136 along shaft 112 relative to outer lock dials 104, and to drive inner lock dials 114 toward disengagement from outer lock dials 104 upon the rotation of reset knob 102 toward the reset mode rotational position. The rotation of reset knob 102 toward the normal mode rotational position reverses the axial displacement of reset slide member 124 under the impetus of biasing spring 116, as lugs 140 effectively progress in the downslope direction of ramps 144.

Reset knob 102 includes a lug 146 extending into slot 148 in knob spacer 106. In the depiction of FIG. 7, slot 148 terminates at a clockwise end 150 exposed to the opening 142, and terminates at a counterclockwise end 152. The lug 146 and slot 148 are configured to limit the relative rotational displacement between reset knob 102 and knob spacer 106, e.g., by virtue of the circumferential extents of lug 146 and slot 148. Resettable combination lock mechanism 100 is in the normal mode when reset knob 102 is rotated counterclockwise until lug 146 is disposed at end 152 of slot 148, and is in the reset mode when reset knob 102 is rotated clockwise until lug 146 is disposed at end 150.

Figure 8:
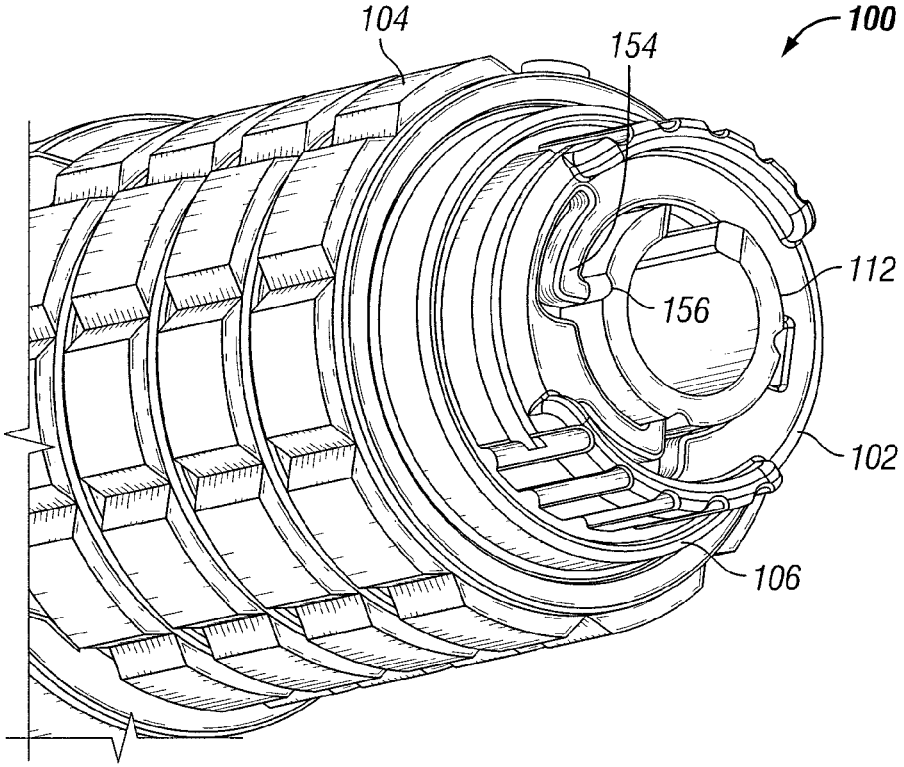
FIG. 8 is an isometric view of some aspects of a non-limiting example of a resettable combination lock mechanism illustrating detent features configured to provide sensible and/or audible feedback to confirm having switched to a normal mode or to a reset mode.
Figure 9:
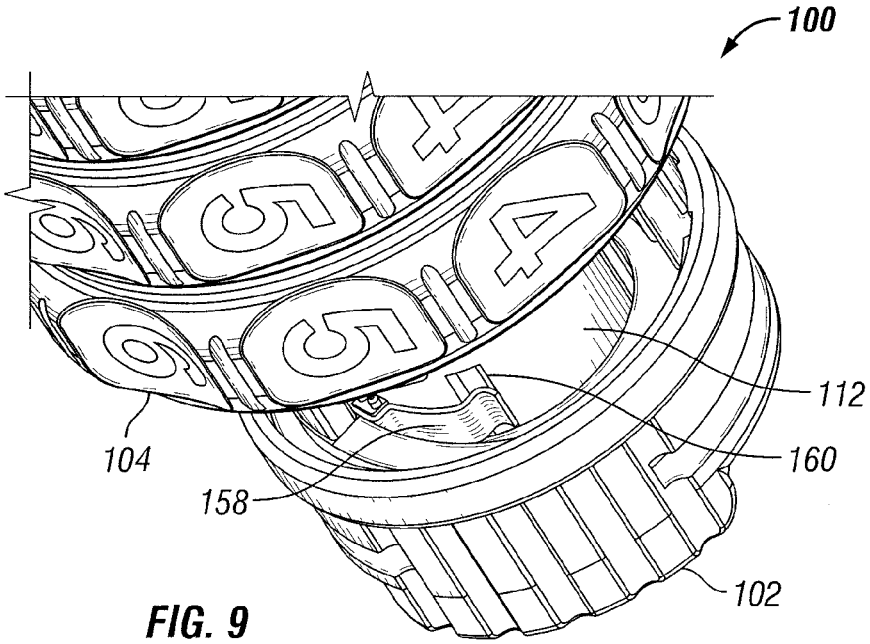
FIG. 9 is an isometric view of some aspects of a non-limiting example of a resettable combination lock mechanism illustrating detent features configured to provide sensible and/or audible feedback to confirm having switched to a normal mode or to a reset mode.

Referring to FIGS. 8 and 9, in some embodiments resettable combination lock mechanism 100 may include a detent feature that provides a finger-sensible and/or hand-sensible feedback or audible feedback to indicate when reset knob 102 has been fully rotated into the reset mode rotational position or the normal mode rotational position in the depiction of FIG. 8, reset knob 102 is formed of a plastic or composite material and includes an integral spring 154 that is configured to engage one instance of a groove 156 when reset knob 102 has been rotated fully into the reset mode rotational position; and engages another instance of a groove 156 when reset knob 102 has fully reached the normal mode rotational position. Similarly, an example of FIG. 9, a spring 158 is configured to engage one instance of a groove 160 when reset knob 102 has fully reached the reset mode rotational position; and engages another instance of a groove 160 when reset knob 102 has fully reached the normal mode rotational position. In the depiction of FIG. 9, reset knob 102 is metallic, and spring 158 is a metallic spring coupled or affixed to reset knob 102.

Figure 10:
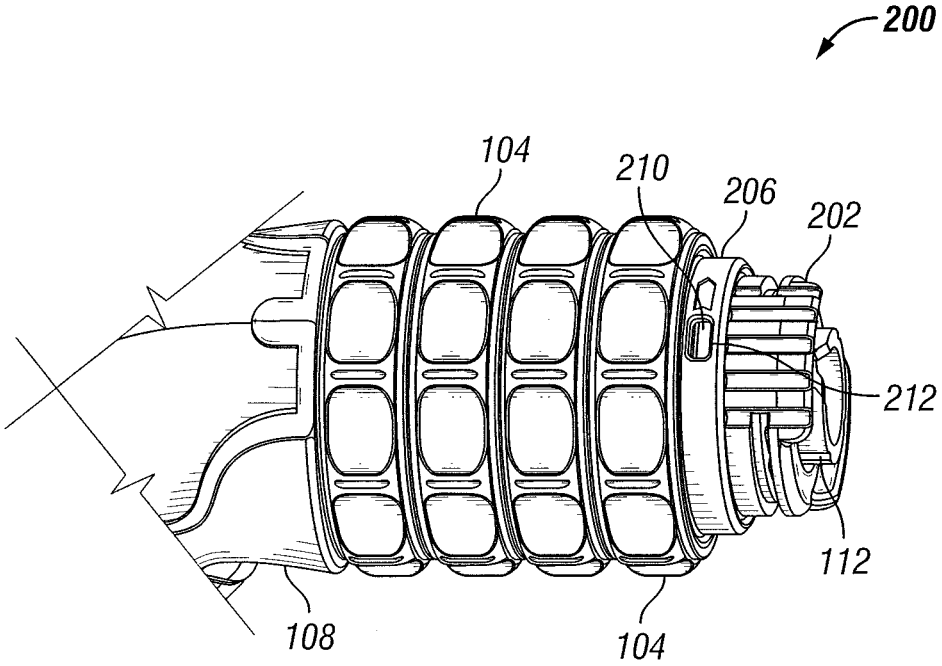
FIG. 10 illustrates some aspects of a non-limiting example of a resettable combination lock mechanism in accordance with an embodiment of the present invention, wherein a visual indicator is exposed via a window, indicating that the resettable combination lock mechanism is in the reset mode.
Figure 11:
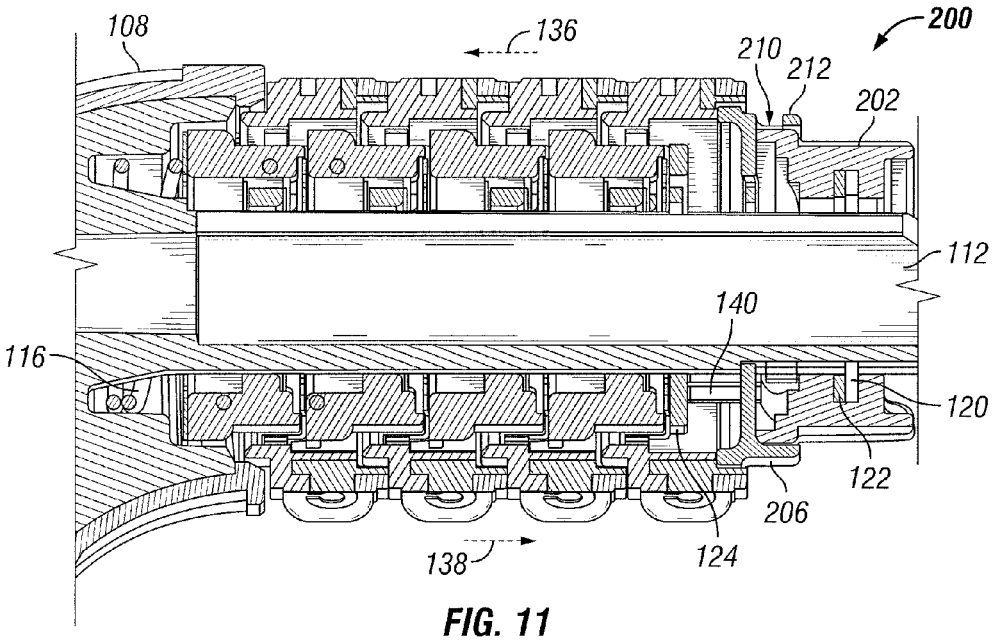
FIG. 11 is a sectional view illustrating some aspects of a non-limiting example of a resettable combination lock mechanism in accordance with the embodiment of FIG. 10.
Figure 12:
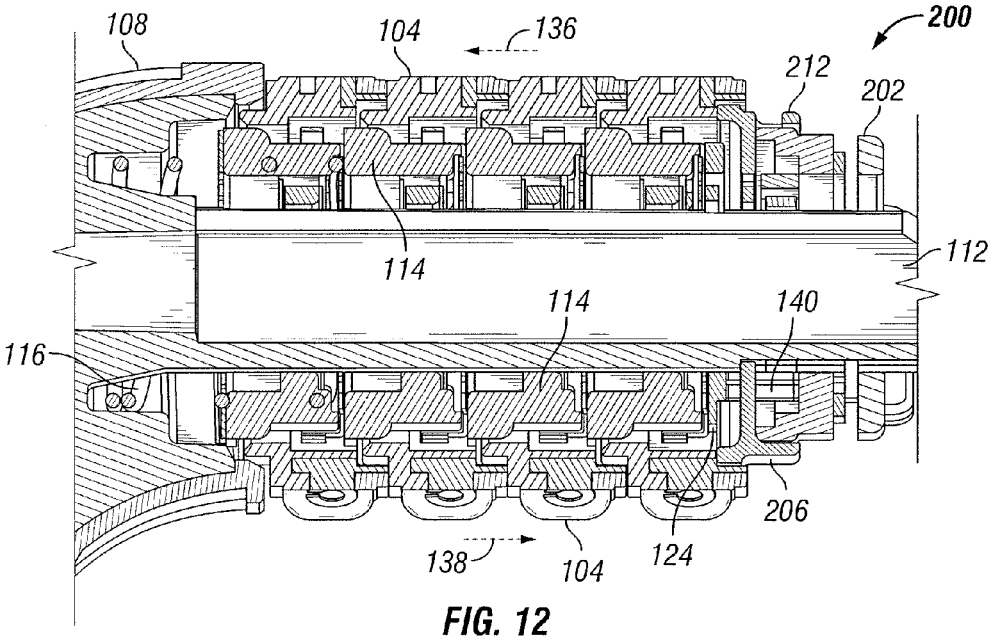
FIG. 12 is a sectional view illustrating some aspects of a non-limiting example of a resettable combination lock mechanism in accordance with the embodiment of FIG. 10.

Referring to FIGS. 10-12, some aspects of a non-limiting example of resettable combination lock mechanism 200 and accordance with an embodiment of the present invention is illustrated. In many respects, the embodiment of FIGS. 10-12 is identical to the embodiment of FIGS. 1-9 in some respects, and is substantially similar to the embodiment of FIGS. 1-9 in many respects, and hence, any such identical or substantially similar features are not described below. However, there are some substantial differences between the embodiment of FIGS. 1-9 and the embodiment of FIGS. 10-12. For example, in contrast to the embodiment of FIGS. 1-9, wherein outer lock dials 104 are configured for axial displacement and directions 136 and 138, and the embodiment of FIGS. 10-12, outer lock dials 104 are maintained in a fixed axial position, regardless of whether resettable combination lock mechanism 200 is in the normal mode or the reset mode. It will be seen that resettable combination lock mechanism 200 does not include a biasing spring, such as biasing spring 118 of resettable combination lock mechanism 100, as such spring is not necessary because outer lock dials 104 are retained in a fixed axial position.

Resettable combination lock mechanism 200 includes, outer lock dials 104, support structure 108, inner lock dials 114, reset slide member 124 having lugs 140, a reset knob 202, a knob spacer 206, a visual indicator 210, and a window 212. Outer lock dials 104 and inner lock dials 114 function in the same manner as described above with respect to resettable combination lock mechanism 100, except that outer lock dials 104 are retained in a fixed axial position in resettable combination lock mechanism 200, and do not displace axially to expose a visual indicator that indicates when the resettable combination lock mechanism is in the reset mode. In addition, outer lock dials 104 and inner lock dials 114 are configured for disengagement upon axial displacement of only inner lock dials 114. As with resettable combination lock mechanism 100, reset slide member 124 is anti-rotated by virtue of the engagement of lugs 140 into anti-rotation slots 142 of knob spacer 206. As with knob spacer 106, knob spacer 206 is restrained from rotational motion, but is free to translate in directions 136 and 138. In addition, as with reset knob 102, reset knob 202 includes a ramp (not shown) that is operative to drive reset slide member 124 and inner lock dials 114 in direction 136 and disengage inner lock dials 114 from outer lock dials 104. In one form, knob spacer 206 includes window 212, which is configured to expose visual indicator 210 to the view of the observer when the resettable combination lock mechanism is in the reset mode, and to hide visual indicator 210 from the view of the observer when resettable combination lock mechanism 200 is in the normal mode. Visual indicator 210 is exposed via window 212 when reset knob 202 is rotated into the reset mode rotational position, and is hidden from window 212 when reset knob 202 is rotated into the normal mode rotational position. In one form, visual indicator 210 is brightly colored. In other embodiments, visual indicator 210 may use other means to catch the human eye e.g. those mentioned above with respect to visual indicator 110. In one form, visual indicator 210 is integral with reset knob 202. In other embodiments visual indicator 210 maybe coupled or affixed to reset knob 202.

In some embodiments, the window in knob spacer 206 may be configured, e.g., by its circumferential position on knob spacer 206, to expose visual indicator 210 to the view of the observer when the resettable combination lock mechanism is in the normal mode, and to hide visual indicator 210 from the view of the observer when resettable combination lock mechanism 200 is in the reset mode. In such embodiments, visual indicator 210 is exposed via window 212 when reset knob 202 is rotated into the normal mode rotational position, and is hidden from window 212 when reset knob 202 is rotated into the reset mode rotational position. In still other embodiments, a plurality of visual indicators may be used, e.g., wherein one visual indicator is exposed to window 212 when reset knob 202 is rotated into the reset mode rotational position, and wherein another visual indicator is exposed to window 212 when reset knob 202 is rotated into the normal mode rotational position. In such embodiments, the first visual indicator would have a different appearance than the second visual indicator. In still other embodiments a plurality of windows may also be employed, e.g., wherein one visual indicator is exposed to one window when reset knob 202 is rotated into the reset mode rotational position; and wherein another visual indicator is exposed to another window when reset knob 202 is rotated into the normal mode rotational position.

Embodiments of the present invention include a resettable combination lock mechanism, comprising: a support structure; a shaft extending from the support structure; a plurality of inner lock dials disposed on the shaft; a plurality of outer lock dials disposed radially outward of the inner lock dials, wherein the outer lock dials and inner lock dials are configured to engage and lock to each other rotationally when in a first relative axial position; and wherein the outer lock dials and inner lock dials are configured to disengage and unlock from each other and permit relative rotation therebetween when in second relative axial position; and a visual indicator, wherein the resettable combination lock mechanism is configured to perform one of exposing and hiding at least a part of the visual indicator to or from the view of an observer viewing the resettable combination lock mechanism when the outer lock dials and inner lock dials are in the second relative axial position; and wherein the resettable combination lock mechanism is configured to perform the other of exposing and hiding the visual indicator to or from the view of the observer viewing the resettable combination lock mechanism when the outer lock dials and inner lock dials are in the first relative axial position.

In a refinement, the resettable combination lock mechanism further comprises a first component disposed about the shaft; wherein the first component is configured to be axially restrained on the shaft; and wherein the first component is configured to rotate about the shaft; and a second component disposed about the shaft; wherein the second component is configured to be rotationally restrained about the shaft; and wherein the second component is configured for axial displacement along the shaft, wherein the first component is configured, upon a rotational displacement of the first component, to generate and/or enable a relative axial displacement as between the outer lock dials and the inner lock dials; and wherein the first component and the second component are configured to limit the amount of rotational displacement of the first component.

In a refinement, the resettable combination lock mechanism further comprises a reset slide member disposed about the shaft and abutting the inner lock dials; wherein the first component includes a first ramp configured to engage and axially displace the reset slide member along the shaft and axially displace the inner lock dials relative to the outer lock dials and move the inner lock dials toward disengagement from the outer lock dials upon rotation of the first component.

In another refinement, the reset slide member is configured for axial displacement along the shaft; wherein the second component includes an anti-rotation feature; and wherein the reset slide member includes a lug configured to engage the second component anti-rotation feature and prevent rotation of the reset slide member about the shaft.

In yet another refinement, the resettable combination lock mechanism further comprises a window in the second component, wherein the third component is coupled to a portion of the first component or is a part of the first component; and wherein the third component is visible to the observer through the window when the outer lock dials and inner lock dials are in the second relative axial position.

In still another refinement, the first component and the second component are configured to expose the third component to the window upon a first rotation of the first component.

In yet still another refinement, the first component and the second component are configured to shield the third component from the window upon a second rotation of the first component and a direction opposite to that of the first rotation.

In a further refinement, the resettable combination lock mechanism further comprises a spring configured to bias the inner lock dials toward the first component.

In a yet further refinement, the resettable combination lock mechanism further comprises a reset slide member disposed about the shaft and abutting the inner lock dials, wherein the resettable combination lock mechanism is configured for the spring to bias the inner lock dials against the first component via the reset slide member.

In a yet still further refinement, the third component and the outer lock dials are configured to expose the third component to the view of the observer when the outer lock dials and inner lock dials are in the second relative axial position.

In an additional further refinement, the outer lock dials and the second component are displaced axially toward the first component when the outer lock dials and/or the inner lock dials are moved into the second relative axial position; and wherein the outer lock dials and the second component are displaced axially away from the first component when the outer lock dials and/or the inner lock dials are moved into the second relative axial position.

In another additional further refinement, the resettable combination lock mechanism further comprises a first component ramp disposed on the first component, wherein the first component ramp is configured to engage the second component and selectively drive the second component and the outer lock dials from the first relative axial position to the second relative axial position and to drive the second component and the outer lock dials from the second relative axial position to the first relative axial position upon rotation of the first component.

In yet another additional further refinement, the resettable combination lock mechanism further comprises a second component ramp disposed on the second component, wherein the second component ramp is configured to engage the first component ramp and further drive the second component and the outer lock dials axially along the shaft.

In still another additional further refinement, the second component ramp is rotationally aligned with the first component ramp when the outer lock dials and inner lock dials are in the first relative axial position; and wherein the second component ramp is rotationally misaligned with the first component ramp when outer lock dials and inner lock dials are in the second relative axial position.

In yet still another additional further refinement, the resettable combination lock mechanism further comprises a spring configured to bias the outer lock dials against the second component.

In a further additional refinement, the resettable combination lock mechanism further comprises slots in the shaft and a detent spring coupled to the first component and configured to engage the slots upon rotation of the first component.

Embodiments of the present invention include a resettable combination lock mechanism, comprising: a female locking post configured to receive a male locking post; a plurality of inner lock dials received onto the female locking post; a plurality of outer lock dials, wherein the outer lock dials and the inner lock dials are configured to rotationally engage and lock to each other when displaced in a first axial direction relative to each other; and wherein the outer lock dials and inner lock dials are configured to disengage and unlock from each other and permit relative rotation therebetween when displaced in a second axial direction relative to each other opposite to the first axial direction; a reset knob disposed about the female locking post and configured to be rotated by hand; wherein the reset knob is configured to be axially restrained on the female locking post; and a visual indicator, wherein the resettable combination lock mechanism is configured to one of hide and expose at least a part of the visual indicator from or to the view of an observer viewing the resettable combination lock mechanism when the outer lock dials and/or inner lock dials are moved axially toward axial alignment fit each other and engagement with each other; and wherein the resettable combination lock mechanism is configured to the other of hide and expose the visual indicator relative from or to the view of the observer when the outer lock dials and/or inner lock dials are moved axially away from axial alignment and toward disengagement with each other.

In a refinement, the resettable combination lock mechanism further comprises a knob spacer disposed about the female locking post between the inner lock dials and the reset knob; wherein the knob spacer has a window therein; and wherein the visual indicator is configured to be viewed through the window in the knob spacer to expose the at least the part of the visual indicator to the view of the observer.

In another refinement, the resettable combination lock mechanism is configured to expose the at least the part of the visual indicator when the outer lock dials and/or the inner lock dials are moved in a direction away from axial alignment with each other.

In yet another refinement, the reset knob is configured to drive the outer lock dials and/or the inner lock dials in a direction away from axial alignment with each other upon a first rotation; and wherein the reset knob is configured to drive the outer lock dials and/or the inner lock dials in a direction toward axial alignment with each ether upon a second rotation.

Embodiments of the present invention include a lock assembly comprising: a female locking post having a first end and a second end; a plurality of inner dials disposed about the female locking post between the first end and the second end; a plurality of outer dials disposed about the inner lock dials between the first end and the second end; a reset knob rotationally secured to the female locking post at the first end, wherein the reset knob has a first rotational position and a second rotational position; a lock body disposed at the second end; a visual indicator; and a spring biased between the lock body and the inner lock dials; wherein when the reset knob is in the second rotational position, the lock assembly is in a reset mode and the visual indicator is visible.

An embodiment of a lock assembly is shown in normal use mode with the reset knob in a first position and the outer dials and knob spacer tight to the lock body. The lock assembly is in reset mode with the reset knob in a second position and the outer dials and knob spacer moved away from the lock body exposing a colored indicator between the outer dials and lock body.

The reset knob is provided with outer ramps and inner ramps. The reset knob is also provided with detent tabs to provide feedback to the user. The knob spacer is provided with knob ramps that interact with the outer ramps on the reset knob. This interaction is explained in greater detail herein.

Detent systems provide feedback to the user to affirm whether the lock has been fully switched between normal-use and reset modes. An elastic tab on a plastic reset knob is provided to interact with a recess on an inner lock post. Similarly, a mechanism on a die cast reset knob is provided to interact with recesses on an inner lock post.

The lock assembly may be in reset and normal-use modes. The lock assembly is provided with outer dials that are biased by an outer dial spring. The assembly is further provided with inner dials that are biased by an inner dial spring. The assembly further comprises a reset slide and a spring spacer. The spring spacer is also provided with the colored indicator.

When the reset knob on the lock assembly is in a first rotational position, the outer ramps on the reset knob are disengaged from the knob ramps on the knob spacer. This allows the outer dials to be biased by the outer dial spring and translate, exposing the colored indicator. With the reset knob in the same position, the inner ramps on the reset knob are engaged with the reset slide. This pushes the inner dials against the bias of the inner dial spring and translates the inner dials. Accordingly, the outer dials and inner dials are disengaged allowing the user to reset the lock combination.

In normal-use mode, the reset knob on the lock assembly is in a second rotational position. In this second position, the outer ramps on the reset knob are engaged with the knob ramps on the knob spacer. This allows the outer dials to overcome the bias of the outer dial spring and translate to hide the colored indicator. With the reset knob in the same position, the inner ramps on the reset knob are disengaged from the reset slide which allows the inner dial spring to bias and translate the inner dials. Accordingly, the outer dials and inner dials are engaged allowing the user to use the lock.

The reset knob moves from a first position to a second position by rotation movement.

Another embodiment of a lock assembly includes outer dials that are linearly fixed. The outer dials are tight to the lock body regardless of whether the lock assembly is in normal-use or reset mode. To indicate to a user which mode the lock assembly is in, the knob spacer is provided with an indicator window to visually see a colored indicator on the reset knob.

When the reset knob on the lock assembly is in a first rotational position, inner ramps on the reset knob are engaged with a reset slide. This pushes the inner dials against the bias of an inner dial spring and translates the inner dials. Accordingly, the outer dials and inner dials are disengaged allowing the user to reset the lock combination.

The lock assembly has a normal-use mode. The reset knob on the lock assembly is in a second rotational position. In this second position, inner ramps on the reset knob are disengaged from the reset slide which allows the inner dial spring to bias and translate the inner dials. Accordingly, the outer dials and inner dials are engaged allowing the user to use the lock.

The reset knob moves from a first position to a second position by rotational movement. While the reset knob is in the reset mode, a colored indicator on the reset knob shows through an indicator window on the knob spacer.

While the invention has been described in connection with what presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A resettable combination lock mechanism, comprising:

a male locking post;

a female locking post configured to receive the male locking post;

a plurality of inner lock dials received onto the female locking post;

a plurality of outer lock dials, wherein the outer lock dials and the inner lock dials are configured to rotationally engage and lock to each other when displaced in a first axial direction relative to each other; and wherein the outer lock dials and inner lock dials are configured to disengage and unlock from each other and permit relative rotation therebetween when displaced in a second axial direction relative to each other opposite to the first axial direction;

a reset knob disposed about the female locking post and configured to be rotated by hand; and a visual indicator, wherein the resettable combination lock mechanism is configured to one of hide and expose at least a part of the visual indicator from or to the view of an observer viewing the resettable combination lock mechanism when the outer lock dials and/or inner lock dials are moved axially toward axial alignment with each other and engagement with each other; and wherein the resettable combination lock mechanism is configured to the other of hide and expose the visual indicator relative from or to the view of the observer when the outer lock dials and/or inner lock dials are moved axially away from axial alignment and toward disengagement with each other.

2. The resettable combination lock mechanism of claim 1, further comprising a knob spacer disposed about the female locking post between the inner lock dials and the reset knob; wherein the knob spacer has a window therein; and wherein the visual indicator is configured to be viewed through the window in the knob spacer to expose the at least the part of the visual indicator to the view of the observer.

3. The resettable combination lock mechanism of claim 1, configured to expose the at least the part of the visual indicator when the outer lock dials or the inner lock dials are moved in a direction away from axial alignment with each other.

4. The resettable combination lock mechanism of claim 1, wherein the reset knob is configured to drive the outer lock dials or the inner lock dials in a direction away from axial alignment with each other upon a first rotation; and wherein the reset knob is configured to drive the outer lock dials or the inner lock dials in a direction toward axial alignment with each other upon a second rotation.

5. A resettable combination lock mechanism having a first mode and a second mode, the resettable combination lock mechanism comprising:

a shaft extending along an axis defining a first axial direction and a second axial direction opposite the first axial direction;

a first dial set and a second dial set, wherein one of the first dial set and the second dial set is an inner dial set disposed on the shaft and the other of the first dial set and the second dial set is an outer dial set circumferentially surrounding the inner dial set, wherein the inner dial set includes a plurality of inner lock dials, wherein the outer dial set includes a plurality of outer lock dials, wherein the first dial set has an engaged position in which each of the outer lock dials is rotationally coupled with a corresponding one of the inner lock dials, and a disengaged position in which each of the outer lock dials is rotationally decoupled from the corresponding one of the inner lock dials, and wherein the engaged and disengaged positions are axial positions of the first dial set relative to the second dial set;

a reset knob mounted to the shaft, wherein the reset knob is rotatable relative to the shaft between a first rotational position and a second rotational position, wherein the first rotational position defines the first mode of the resettable combination lock mechanism, and wherein the second rotational position defines the second mode of the resettable combination lock mechanism;

a first sliding component mounted on the shaft, wherein the first sliding component is axially movable relative to the shaft and is restrained from rotation about the shaft, wherein the first sliding component is engaged with the reset knob and the first dial set, and is configured to move the first dial set in the second axial direction toward one of the engaged position and the disengaged position in response to rotation of the reset knob from the first rotational position toward the second rotational position;

a first biasing member engaged with the first dial set, the first biasing member urging the first dial set in the first axial direction, wherein the first biasing member is configured to move the first dial set in the first axial direction toward the other of the engaged position and the disengaged position in response to rotation of the reset knob from the second rotational position toward the first rotational position; and a visual indicator including a first visual indicium relating to the first mode of the resettable combination lock mechanism;

wherein, with the reset knob in the first rotational position, the first visual indicium is exposed to view; and wherein, with the reset knob in the second rotational position, the first visual indicium is hidden from view.

6. The resettable combination lock mechanism of claim 5, wherein the first dial set is the inner dial set, the first sliding component is a reset slide member, the first rotational position of the reset knob is a normal position, the second rotational position of the knob is a reset position, the reset slide member is configured to move the inner dial set in the second axial direction from the engaged position to the disengaged position in response to rotation of the reset knob from the normal position to the reset position, and the first biasing member is configured to move the inner dial set in the first axial direction from the disengaged to the engaged position in response to rotation of the reset knob from the reset position to the normal position.

7. The resettable combination lock mechanism of claim 5, wherein the first dial set is the outer dial set, the first sliding component is a knob spacer, the first rotational position of the reset knob is a reset position, the second rotational position of the knob is a normal position, the knob spacer is configured to move the outer dial set in the second axial direction from the disengaged position to the engaged position in response to rotation of the reset knob from the reset position to the normal position, and the first biasing member is configured to move the outer dial set in the first axial direction from the engaged position to the disengaged position in response to rotation of the reset knob from the normal position to the reset position.

8. The resettable combination lock mechanism of claim 5, further comprising:

a second sliding component mounted on the shaft, wherein the second sliding component is axially movable and is restrained from rotation about the shaft, wherein the second sliding component is engaged with the reset knob and the second dial set, and is configured to move the second dial set in the second axial direction in response to rotation of the reset knob from the second rotational position toward the first rotational position; and a second biasing member engaged with the second dial set, the second biasing member urging the second dial set in the first axial direction, wherein the second biasing member is configured to move the second dial set in the first axial direction in response to rotation of the reset knob from the first rotational position toward the second rotational position.

9. The resettable combination lock mechanism of claim 5, wherein the reset knob includes a ramp engaged with the first sliding component, and wherein the ramp is configured to urge the first sliding component in the second axial direction in response to rotation of the reset knob from the first rotational position toward the second rotational position.

10. The resettable combination lock mechanism of claim 5, wherein the reset knob is configured to expose the first visual indicium when in the first rotational position, and to hide the first visual indicium when in the second rotational position.

11. The resettable combination lock mechanism of claim 5, wherein the visual indicator further includes a second visual indicium relating to the second mode of the resettable combination lock mechanism; wherein, with the reset knob in the first rotational position, the second visual indicium is hidden from view; and wherein, with the reset knob in the second rotational position, the second visual indicium is exposed to view.

12. A resettable combination lock mechanism having a normal mode and a reset mode, the resettable combination lock mechanism comprising:

a shaft extending along an axis;

a first dial set including a plurality of first locking dials mounted for rotation about the axis;

a second dial set including a plurality of second locking dials mounted for rotation about the axis, wherein the second dial set is axially movable relative to the first dial set between an engaged position in which each of the first locking dials is rotationally coupled with a corresponding one of the second locking dials and a disengaged position in which each of the first locking dials is rotatable with respect to the corresponding one of the second locking dials; and a reset knob mounted for rotation about the axis between a normal position defining the normal mode and a reset position defining the reset mode;

a sliding component mounted on the shaft, wherein the sliding component is axially movable relative to the shaft and is restrained from rotation about the shaft, wherein the sliding component is engaged with the reset knob and the second dial set, and wherein the sliding component is configured to move the second dial set from the engaged position to the disengaged position in response to rotation of the reset knob from the normal position to the reset position;

a biasing member engaged with the second dial set, wherein the biasing member is configured to move the second dial set from the disengaged position to the engaged position in response to rotation of the reset knob from the reset position to the normal position;

a visual indicator including a first visual indicium indicative of the reset mode;

wherein the reset knob is configured to hide the first visual indicium when in the normal position, thereby indicating that the resettable combination lock mechanism is operating in the normal mode; and wherein the reset knob is configured to expose the first visual indicium when in the reset position, thereby indicating that the resettable combination lock mechanism is operating in the reset mode.

13. The resettable combination lock mechanism of claim 12, wherein the sliding component includes a lug engaged with the reset knob, the reset dial includes a ramp structured to engage the lug and urge the sliding component axially away from the reset knob as the reset knob rotates from the normal position to the reset position.

14. The resettable combination lock mechanism of claim 12, wherein the reset knob includes the visual indicator.

15. The resettable combination lock mechanism of claim 12, wherein the first dial set is an outer dial set, the second dial set is an inner dial set, and the outer dial set circumferentially surrounds the inner dial set.

16. The resettable combination lock mechanism of claim 12, wherein the visual indicator further includes a second visual indicium indicative of the normal mode, wherein the reset knob is configured to expose the second visual indicium when in the normal position, and to hide the second visual indicium when in the reset position.

17. The resettable combination lock mechanism of claim 16, wherein the first visual indicium comprises a first color, and the second visual indicium comprises a second color different from the first color.

18. The resettable combination lock mechanism of claim 16, further comprising a window; wherein with the reset knob in the reset position, the window is aligned with the first visual indicium and is misaligned with the second visual indicium; and wherein with the reset knob in the normal position, the window is aligned with the second visual indicium and is misaligned with the first visual indicium.

* * * * *